US012342969B2

(12) United States Patent
Sbeglia

(10) Patent No.: US 12,342,969 B2
(45) Date of Patent: Jul. 1, 2025

(54) SHOWER CADDY

(71) Applicant: MerchSource, LLC, Irvine, CA (US)

(72) Inventor: Adam Sbeglia, Fullerton, CA (US)

(73) Assignee: MerchSource, LLC, Irvine, CA (US)

( * ) Notice: Subject to any disclaimer, the term of this patent is extended or adjusted under 35 U.S.C. 154(b) by 94 days.

(21) Appl. No.: 18/079,703

(22) Filed: Dec. 12, 2022

(65) Prior Publication Data

US 2023/0180967 A1 Jun. 15, 2023

Related U.S. Application Data

(60) Provisional application No. 63/289,005, filed on Dec. 13, 2021.

(51) Int. Cl.

| | |
|---|---|
| ***A47K 3/28*** | (2006.01) |
| ***A47B 45/00*** | (2006.01) |
| ***A47B 57/26*** | (2006.01) |

(52) U.S. Cl.

CPC ..... *A47K 3/281* (2013.01); *A47B 45/00* (2013.01); *A47B 57/26* (2013.01)

(58) Field of Classification Search

CPC ..... A47K 3/281; A47B 45/00; A47B 57/26; A47B 55/00

USPC ..... 4/605, 559, 610; 211/134, 187, 207; D6/525, 562

See application file for complete search history.

(56) References Cited

U.S. PATENT DOCUMENTS

| | | | |
|---|---|---|---|
| D564,257 | S | 3/2008 | Yang et al. |
| D568,658 | S | 5/2008 | Yang et al. |
| D569,148 | S | 5/2008 | Yang et al. |
| D572,502 | S | 7/2008 | Yang et al. |
| D622,990 | S | 9/2010 | Yang et al. |
| D651,837 | S | 1/2012 | Yang et al. |
| D651,838 | S | 1/2012 | Yang et al. |
| 8,225,946 | B2 | 7/2012 | Yang et al. |
| 8,348,072 | B2 | 1/2013 | Whitehall et al. |
| 8,408,405 | B2 | 4/2013 | Yang et al. |
| D683,165 | S | 5/2013 | Yang et al. |
| 8,474,632 | B2 | 7/2013 | Yang et al. |
| 8,763,821 | B2 | 7/2014 | Yang et al. |
| D726,441 | S | 4/2015 | Yang et al. |
| D727,060 | S | 4/2015 | Yang et al. |
| 9,107,495 | B2 | 8/2015 | Lindo et al. |
| 9,107,496 | B2 | 8/2015 | Lindo et al. |
| 9,339,151 | B2 | 5/2016 | Yang et al. |
| D769,641 | S | 10/2016 | Yang et al. |
| D770,197 | S | 11/2016 | Yang et al. |
| D770,198 | S | 11/2016 | Yang et al. |
| 9,770,138 | B2 | 9/2017 | Engell |
| D805,318 | S | 12/2017 | Umholtz et al. |
| D806,434 | S | 1/2018 | Yang et al. |
| 9,883,742 | B2 | 2/2018 | Yang et al. |
| 9,943,192 | B2 | 4/2018 | Yang et al. |
| D824,189 | S | 7/2018 | Yang et al. |
| 10,064,523 | B2 | 9/2018 | Engell et al. |
| 10,485,383 | B2 | 11/2019 | Worden, IV et al. |

(Continued)

*Primary Examiner* — Tuan N Nguyen

(74) *Attorney, Agent, or Firm* — Avyno Law P.C.

(57) ABSTRACT

A shower caddy, such as a vertical shower caddy, hanging shower caddy, or standing shower caddy, includes one or more elongated tubular members. The elongated tubular member may be extendable along its elongated length and support shelves. The shelves may be adjusted to different vertical positions on the elongated tubular member.

19 Claims, 19 Drawing Sheets

(56) References Cited

U.S. PATENT DOCUMENTS

| | | | | |
|---|---|---|---|---|
| D877,533 | S | 3/2020 | Appelbaum et al. | |
| 2015/0257533 | A1* | 9/2015 | Yang | A47B 57/26 211/119.011 |
| 2019/0174967 | A1* | 6/2019 | Worden, IV | A47K 3/281 |

* cited by examiner

SHOWER CADDY

RELATED APPLICATIONS

This application claims the benefit under 35 U.S.C. § 119(e) of U.S. Provisional Patent Application Ser. No. 63/289,005, filed Dec. 13, 2021, titled "SHOWER CADDY," the content of which is incorporated by reference herein in its entirety.

TECHNICAL FIELD

The invention relates to shower caddy devices that can be used for storing and/or organizing personal articles, namely bath-related articles.

BACKGROUND

Certain shelving devices, such as those commonly known as "shower caddies," are used in showers or baths for storing and/or organizing personal care articles, such as shampoos, conditioners, soaps, razors, toothbrushes, bath sponges, etc. Shower caddies typically include shelves or baskets for holding these personal care items. Some shower caddies are configured to be mounted between two parallel surfaces such as the bottom surface or floor of a shower or bath and a ceiling and may be referred to as "tension-mounted shower caddies." Other shower caddies are configured to hang, particularly on a shower head, and may be referred to as "hanging shower caddies." Other shower caddies are configured to stand by themselves, and may be referred to as "standing shower caddies." However, regardless of the configuration, many shower caddies in the prior art are difficult to install, malfunction frequently, and/or provide poorly designed shelving systems that only promulgate the clutter and disorganization of personal care articles placed on such shelving systems.

Therefore, a need exists for shower caddy devices that solve the foregoing problems.

SUMMARY

The present disclosure provides a shower caddy that can be used for storing and/or organizing personal articles, namely bath-related articles.

According to an implementation, a shower caddy includes: a first body comprising a telescoping first end and a first free end; a second body comprising a telescoping first end and a second free end, wherein the telescoping first end of the first body is coupled to the telescoping first end of the second body such that the second body is slidable relative to the first body along a longitudinal axis of the shower caddy, and the first body and the second body are configured for telescopic movement to allow variation of a length of the shower caddy along the longitudinal axis; a shelf supported by the first body or the second body; and an extension mechanism configured to adjust the length of the shower caddy, and comprising a spring member configured to bias the first body to the second body.

Other devices, apparatus, systems, methods, features, and advantages of the invention will be or will become apparent to one with skill in the art upon examination of the following figures and detailed description. It is intended that all such additional systems, methods, features, and advantages be included within this description, be within the scope of the invention, and be protected by the accompanying claims.

BRIEF DESCRIPTION OF THE DRAWINGS

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

The present disclosure relates to shower caddy devices that can be used for storing and/or organizing personal articles, namely bath-related articles.

Figure 1:
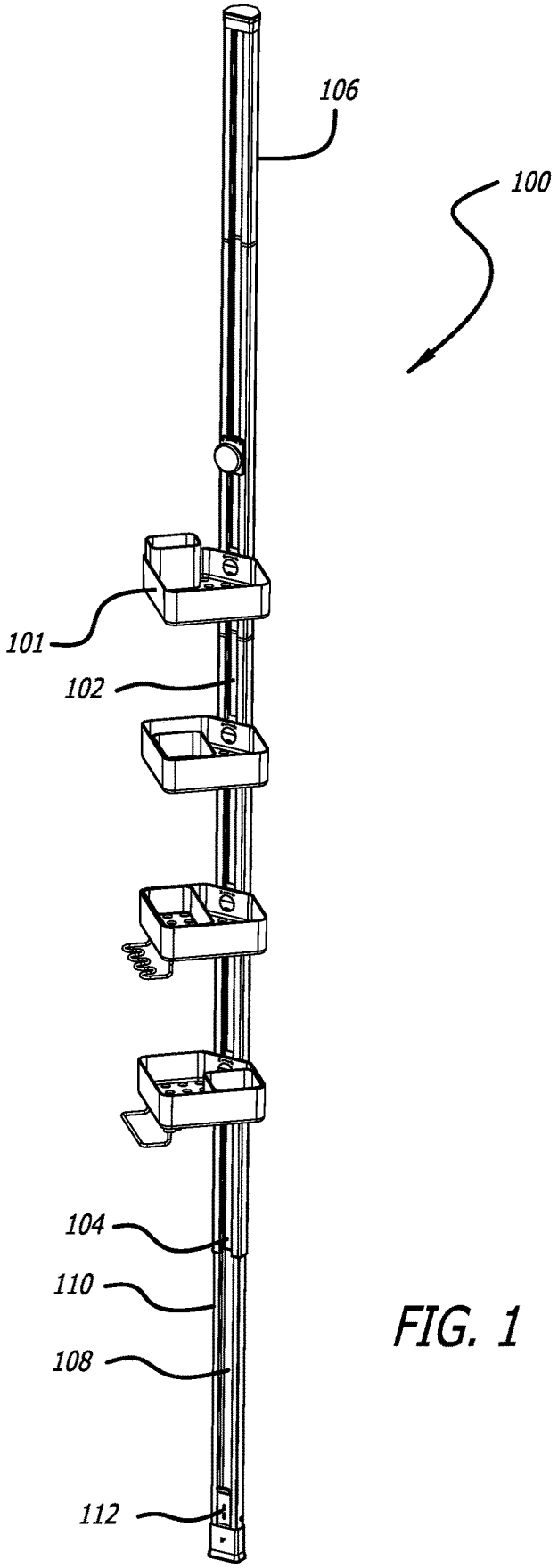
FIG. 1 is a front perspective view of one example of a shower caddy according to an implementation of the present disclosure.

FIG. 1 is a front perspective view of one example of a shower caddy 100 of the present disclosure. The shower caddy 100 may be configured as a tension-mounted shower caddy. In particular, the shower caddy 100 may be mounted between two substantially parallel support surfaces (e.g., the bottom surface or floor of a shower or bath, and a ceiling). The shower caddy 100 is configured to support at least one shelf 101. For example, the shower caddy 100 may have one, two, three, four, or more shelves 101 that may vary in different shapes and/or sizes and/or functional features. In general, the shower caddy 100 includes a first telescoping tubular body (or first telescoping body, or first tubular body, or first body) 102 and a second telescoping tubular body (or second telescoping body, or second tubular body, or second body) 108. That is, in the present example, the first body 102 and the second body 108 are tubular at least in the sense that they are structural members elongated along a longitudinal axis of the shower caddy 100, which corresponds to the vertical direction (i.e., perpendicular to a horizontal plane such as the floor of a shower or bath). Moreover, the first body 102 and the second body 108 are configured for telescopic movement along the longitudinal axis (vertical direction), as described further below. Further the first body 102 and/or the second body 108 are at least partially hollow (i.e., like a tube) as needed to realize the telescoping movement and accommodate features or devices such as described below.

In the present example, the first body 102 includes a telescoping first end 104 and a first free end 106, and the second body 108 includes a telescoping first end 110 and a second free end 112. As shown in FIG. 1, the telescoping first end 104 of the first body 102 may be coupled to the telescoping first end 110 of the second body 108. The first and second bodies 102, 108 are telescoped to allow variation of the length/height of the shower caddy 100 along the longitudinal axis (vertical direction). For example, the second body 108 may be smaller in diameter compared to the first body 102 such that second body 108 slides inside and relative to the first body 102. The respective first and second free ends 106, 112 of the first and second bodies 102, 108 are positioned axially opposite to each other. Each of the first and second free ends 106, 112 may be provided with a padded and/or gripping surface member for contacting one of the above-noted support surfaces without damaging that support surface in any way and to provide a better grip to the support surfaces. Generally, the shower caddy 100 has an upper (or top) end and a lower (or bottom) end. In the present example, the first free end 106 corresponds to (or is located near) the upper end of the shower caddy 100, and the second free end 112 corresponds to (or is located near) the lower end of the shower caddy 100.

In the present example, the second body 108 is positioned inside the first body 102. Alternatively, the first body 102 may be positioned inside the second body 108.

Figure 2:
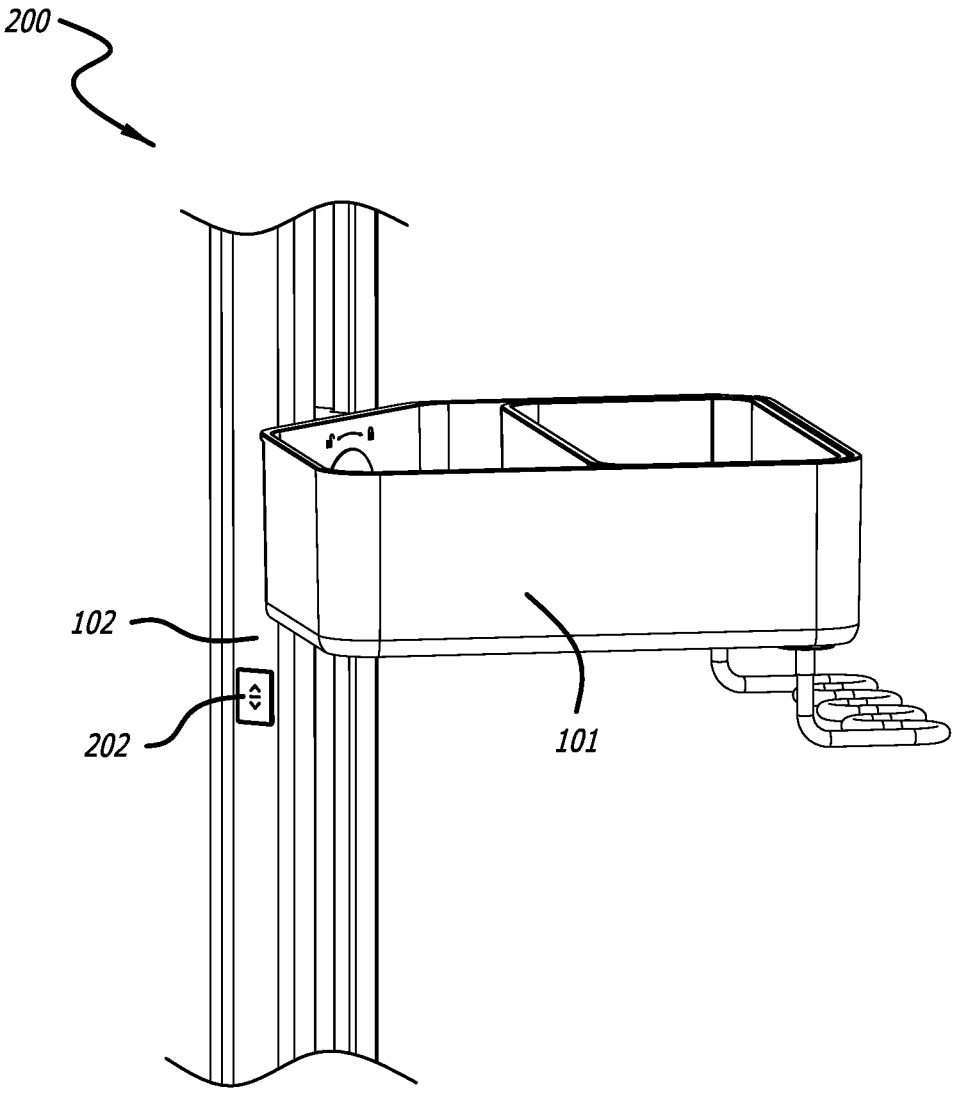
FIG. 2 is a perspective view of an example of an extension mechanism that may be mounted to the shower caddy illustrated in FIG. 1 according to an implementation of the present disclosure.

FIG. 2 shows an example of an extension mechanism 200 that may be mounted to the shower caddy of FIG. 1. As shown in FIG. 2, the extension mechanism 200 may include an actuator 202 that is mounted to the first body 102 for adjusting the span of the shower caddy 100.

Figure 3C:
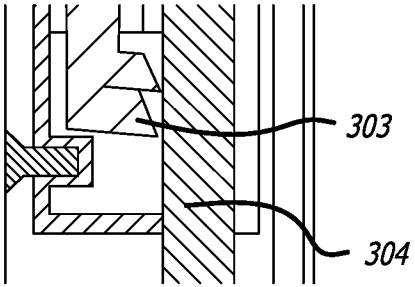
FIG. 3C is a detailed cross-sectional view of a portion of the extension mechanism illustrated in FIG. 3B.
Figure 3B:
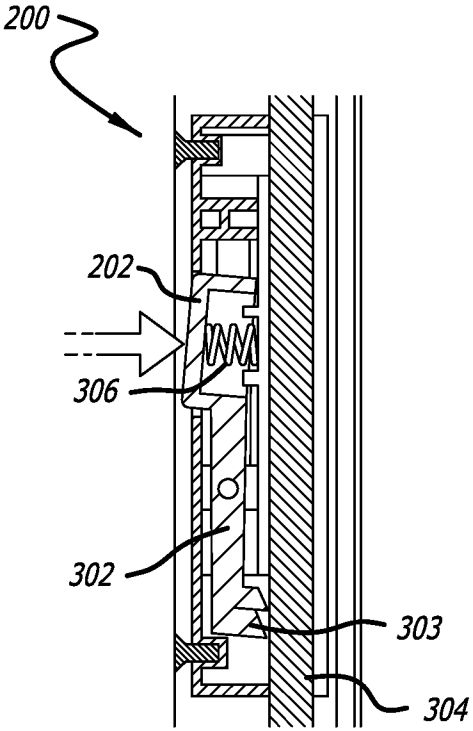
FIG. 3B is another cross-sectional view of the extension mechanism illustrated in FIG. 2, showing a different operational state.
Figure 3A:
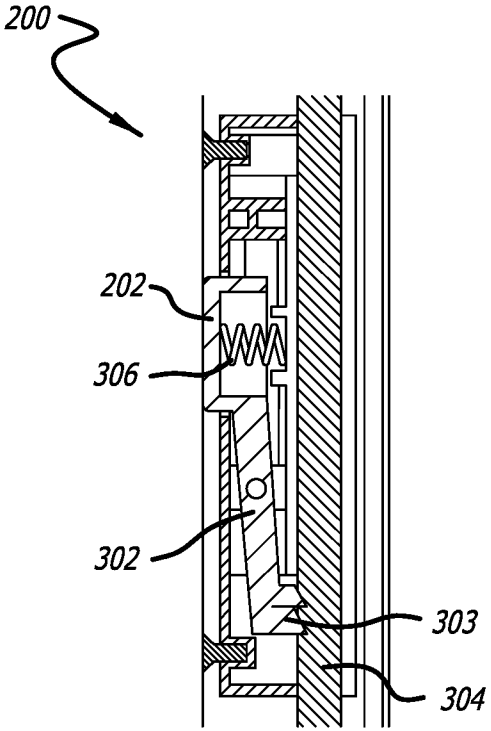
FIG. 3A is a cross-sectional view of the extension mechanism illustrated in FIG. 2.

FIG. 3A-3B are cross-sectional views of the extension mechanism of FIG. 2. In the present example, the actuator 202 is configured to alternately engage the first body 102 and the second body 108 to each other and disengage the first body 102 and the second body 108 from each other. In the present example, the engagement/disengagement is realized by a first locking (or engagement) member 302 and a second locking (or engagement) member 304. The actuator 202 includes, or is coupled to, the first locking member 302 such that the first locking member 302 is mounted to the first body 102 via the actuator 202. Also in this example, the second locking member 304 is mounted to (e.g., inside), or is part of, the second body 108. The first locking member 302 has first locking member teeth 303 configured to engage complementary second locking teeth of the second locking member 304. The first locking member 302 is configured to pivot relative to (alternately toward and away from) the second locking member 304 in response to user-operated actuation of the actuator 202. The second locking member 304 is configured as a toothed rack that slides with the second body 108 within the first body 102.

In operation, the first locking member 302 of the actuator 202 is configured to move between engagement with and disengagement from the second locking member 304 as just described. The actuator 202 may further include at least one (first) spring member 306 configured to bias the teeth 303 of the first locking member 302 into engagement with the teeth of the second locking member 304. The teeth of the second locking member 304 may be axially distributed along at least part the length of the second body 108 either continuously or in a plurality of axially spaced groups of teeth. Thus, more generally, the spring member 306 is configured to bias the first body 102 to (toward) the second body 108. As shown in FIG. 3B, when the actuator 202 is pressed by the user (see arrow in FIG. 3B), the first locking member 302 disengages from the second locking member 304, thereby allowing the second body 108 to slide freely relative to (and within) the first body 102. When the actuator 202 is released (i.e., no longer pressed), the first locking member 302 engages with the second locking member 304 (i.e., by a meshed or toothed engagement in the present example), thereby allowing the second body 108 to become locked within the first body 102 (i.e., thereby locking or fixing the axial position of the second body 108 relative to the first body 102). When the actuator 202 is released, the teeth of the first locking member 302 may be slid along the second locking member 304 until the teeth of the first locking member 302 find engagement with teeth of the second locking member 304 at a certain axial position. This extension mechanism 200 allows the user to manually adjust the overall length of the shower caddy 100 to better accommodate to the varying distances between two substantially parallel support surfaces (e.g., a floor and a ceiling), such that the shower caddy 100 can be mounted properly between the two substantially parallel support surfaces.

FIG. 3C shows a closer view of the first locking member 302 of the actuator 202 disengaging with the second locking member 304.

Figure 4:
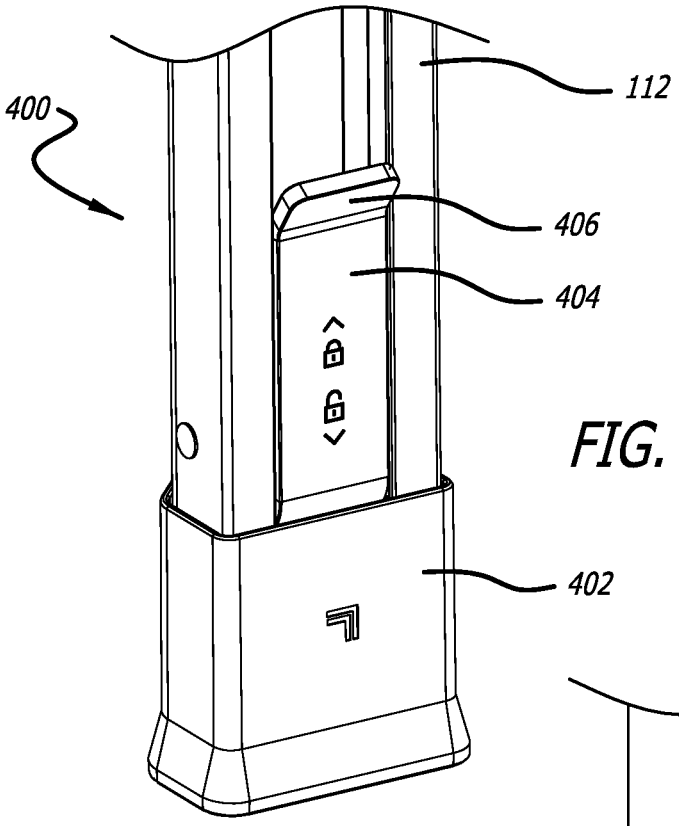
FIG. 4 is a front perspective view of an example of extension foot assembly of the shower caddy illustrated in FIG. 1 according to an implementation of the present disclosure.

FIG. 4 is an enlarged perspective view of an extension foot assembly 400 of the shower caddy 100 of FIG. 1, which is located at or near the lower end of the shower caddy 100. The extension foot assembly 400 may be configured to provide additional fine tensioning of the shower caddy 100 on a support surface (e.g., configured to adjust tensioning of the shower caddy 100 at the second free end 112 of the second body 108). With reference to FIGS. 4-10, the extension foot assembly 400 includes a foot member 402 movably connected to the free end 112 of the second body 108. The extension foot assembly 400 also includes a lever 404 operably coupled to the foot member 402. The lever 404 is configured to move (e.g., rotate, or pivot) between a retracted position (e.g., FIG. 4) and an outward position (e.g., FIG. 9). As the lever 404 moves toward the outward position, the foot member 402 retracts into (or around) the free end 112 of the second body 108, or the second body 108 retracts into (or around) the foot member 402, depending on the implementation. For example, as the lever 404 moves toward the outward position, the second body 108 moves downward toward, and possibly further into, the foot member 402 (or the foot member 402 moves upward toward and, and possibly further around, the second body 108). On the other hand, as the lever 404 moves toward the retracted position, the foot member 402 expands or moves outwardly from the free end 112 of the second body 108, or the free end 112 of the second body 108 expands or moves outwardly from the foot member 402, depending on the implementation. For example, as the lever 404 moves toward the retracted position, the second body 108 moves upward and away from the foot member 402 (or the foot member 402 moves downward and away from the second body 108).

In the present example, the extension foot assembly 400 is configured such that movement of the lever 404 to the outward position releases or decreases the tension on the shower caddy 100, and movement of the lever 404 to the retracted position increases the tension on the shower caddy 100. Alternatively, the extension foot assembly 400 may be configured in an opposite manner. That is, the extension foot assembly 400 may be configured such that movement of the lever 404 to the outward position increases the tension on the shower caddy 100, and movement of the lever 404 to the retracted position releases or decreases the tension on the shower caddy 100.

More generally, as the lever 404 moves toward either the outward position or the retracted position, the free end 112 of the second body 108 moves relative to the foot member 402 (or vice versa) along the axial (vertical) direction (i.e., along the longitudinal axis of the shower caddy 100), in either case providing a fine adjustment of the tensioning on the shower caddy 100 relative to the underlying support surface. In the present example, the movement of the foot member 402 and the free end 112 of the second body 108 toward and away from each other is a linear translation along the longitudinal axis of the shower caddy 100. The movement of the lever 404 to the outward position and to the retracted position changes the axial positions of the foot member 402 and the free end 112 of the second body 108 relative to each other. Moving the lever 404 to the outward position axially shifts (translates) at least one of the foot member 402 or the free end 112 of the second body 108 toward the other. On the other hand, moving the lever 404 to the retracted position changes the axial positions of the foot member 402 and the free end 112 of the second body 108 relative to each other. Moving the lever 404 to the outward position axially shifts (translates) at least one of the foot member 402 or the free end 112 of the second body 108 away from the other.

Figure 5:
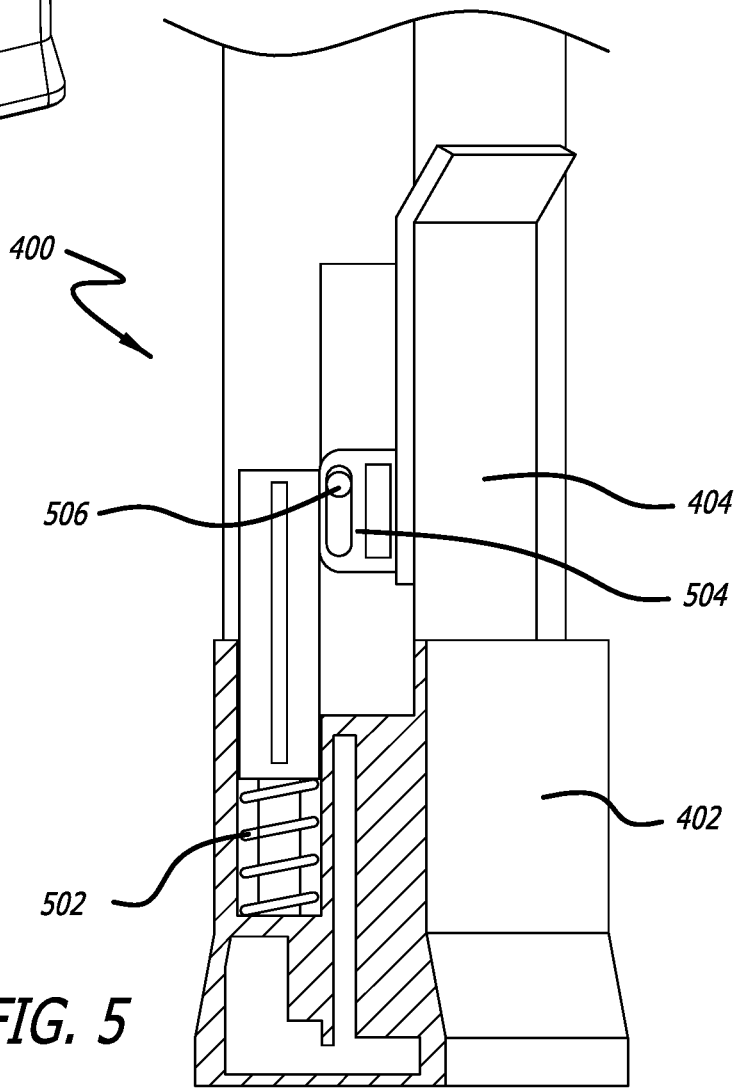
FIG. 5 is a cross-sectional view of the extension foot assembly illustrated in FIG. 4, where a lever of the extension foot assembly is positioned down along the length of the shower caddy and in a retracted position.

In FIG. 4, the lever 404 is shown in the retracted position, whereby the foot member 402 has been expanded or extended outwardly from the free end 112 of the second body 108 against a support surface. As shown, the lever 404 may be structured as a flat panel having a front surface and rear surface where the front surface of the lever 404 substantially conforms and is flush with the shape of the second body 108 for aesthetic purposes. Also, the top of the lever 404 may include a handle 406 that is angled outward for a user to grip for moving the lever 404 between the retracted position and the outward position FIG. 5 shows a cross-sectional view of the extension foot assembly 400 of the shower caddy 100 of FIG. 1, with the lever 404 positioned down along the length of the shower caddy 100 and in the retracted position. As shown in FIG. 5, the extension foot assembly 400 also includes a (second) spring member 502 operably contacting both the lever 404 and the foot member 402 either by attachment/connection or abutment. When the lever 404 is in the retracted position, the spring 502 is compressed, thus allowing the foot member 402 to be tensioned or biased against the underlying support surface that supports the shower caddy 100 (and which support surface is in contact with the foot member 402). FIG. 5 also shows the lever 404 including a sliding groove member 504 having an elongated opening and a sliding member 506 (e.g., a pin, protrusion, etc.) positioned at least partially in the elongated opening. The sliding groove member 504 is configured to slide up and down relative to the sliding member 506, for example in response to movement of the lever 404. The purpose of the sliding groove member 504 is to limit the vertical range of the lever 404 when the lever 404 is in the retracted position and slides up and down along the length of the second body 108.

Figure 6:
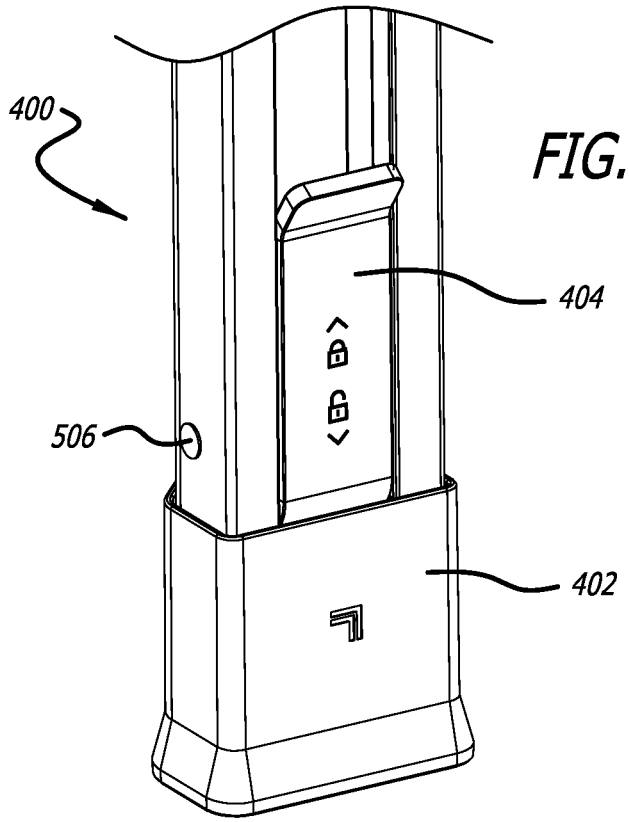
FIG. 6 is a front perspective view of the extension foot assembly illustrated in FIG. 4, where the lever is positioned up along the length of the shower caddy and in the retracted position.
Figure 7:
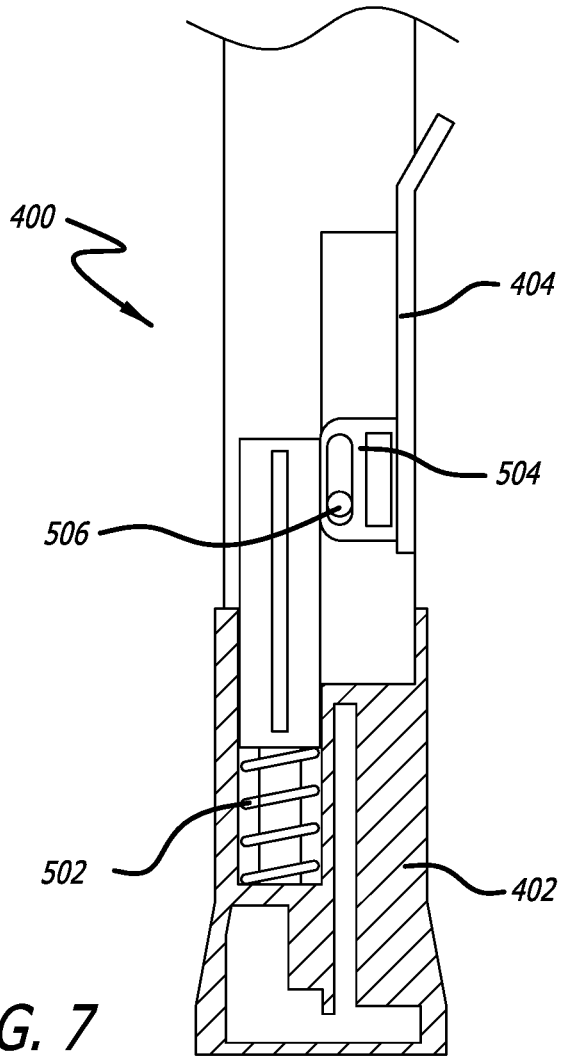
FIG. 7 is a cross-sectional view of the extension foot assembly illustrated in FIG. 4, where the lever is positioned up along the length of the shower caddy and in the retracted position.

To release the tension of the foot member 402 against a support surface, the lever 404 may slide upward from behind the foot member 402 along the length of the second body 108. FIGS. 6 and 7 show perspective and cross-sectional views, respectively, of the extension foot assembly 400 of the shower caddy 100 of FIG. 1, where the lever 404 is positioned up along the length of the shower caddy 100 and in the retracted position (in particular, compare FIGS. 5 and 7, or compare FIGS. 8 and 10). As shown in FIG. 7, the sliding member 506 may limit the vertical translation of the lever 404. The position of the lever 404 shown in FIGS. 6 and 7 may be an intermediate position between the retracted position and the outward position described above.

Figure 8:
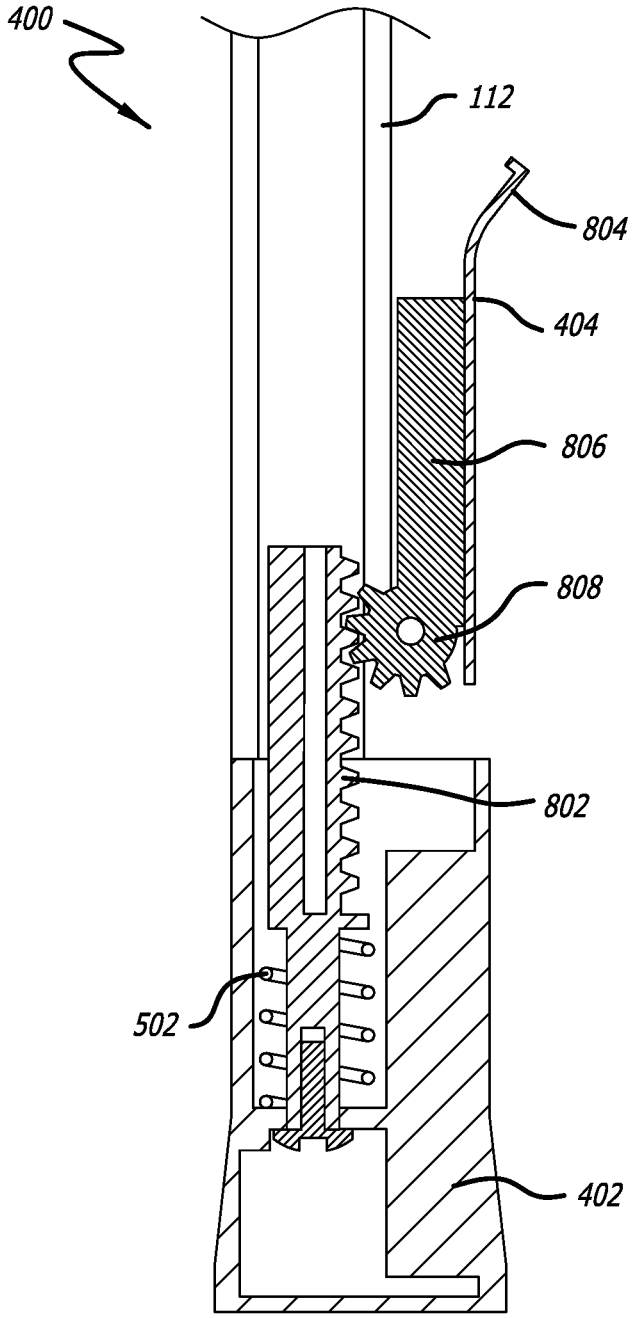
FIG. 8 is another cross-sectional view of the extension foot assembly illustrated in FIG. 4, where the lever is positioned up along the length of the shower caddy and in the retracted position.

FIG. 8 shows another cross-sectional view of the extension foot assembly 400 of the shower caddy 100 of FIG. 1 where the lever 404 is positioned up along the length of the shower caddy 100 and in the retracted position. In the present example, the lever 404 includes a rail 804, an arm 806, and a spur gear (or pinion) 808. The rear surface of the lever 404 may serve as, or include, the rail 804. The rail 804 is configured to slide up and down relative to the arm 806. The arm 806 is attached to or integral with the spur gear 808. While the rail 804 slides up and down relative to the arm 806, the rail 804 is connected to the arm 806 such that when the lever 404 is moved between the retracted and outward positions (the outward position is shown in FIGS. 9 and 10), the arm 806 also moves between the retracted and outward position with the lever 404.

FIG. 8 also shows the foot member 402 having a toothed rack 802 that slidably moves within the free end 112 of the second body 108. As shown, the spur gear 808 engages with the toothed rack 802 such that when the lever 404 is moved between the retracted and outward position, the spur gear 808 rotates, thus moving the toothed rack 802 and the foot member 402 linearly along the length of the second body 108. As also shown, the toothed rack 802 may also engage or contact the spring 502 either by attachment/connection or abutment.

More generally, the lever 404 includes a first engagement member (that is or includes the spur gear 808 in the present example) and the foot member 402 has a second engagement member (that is or includes the toothed rack 802 in the present example). The first engagement member and the second engagement member are maintained in constant contact with each other. The first engagement member is movable, and more specifically rotatable or pivotable in the present example. The second engagement member is attached in a fixed manner to the foot member 402, such as to an inside surface of the foot member 402 in the present example. Accordingly, the second engagement member is movable together with the foot member 402, which may include movement or extension into the free end 112 of the second body 108 as illustrated in FIG. 8. The first engagement member and the second engagement member are configured such that the second engagement member (and thus also the foot member 402) is movable in response to movement of the first engagement member. In the present example, this relative movement is enabled by the meshed or toothed engagement between the first engagement member and the second engagement member, and more specifically between the spur gear 808 and toothed rack 802. Moreover, the relative movement of the first engagement member and second engagement member are associated with (or a consequence of) the movement of the lever 404 between the retracted position and the outward position described above.

Figure 9:
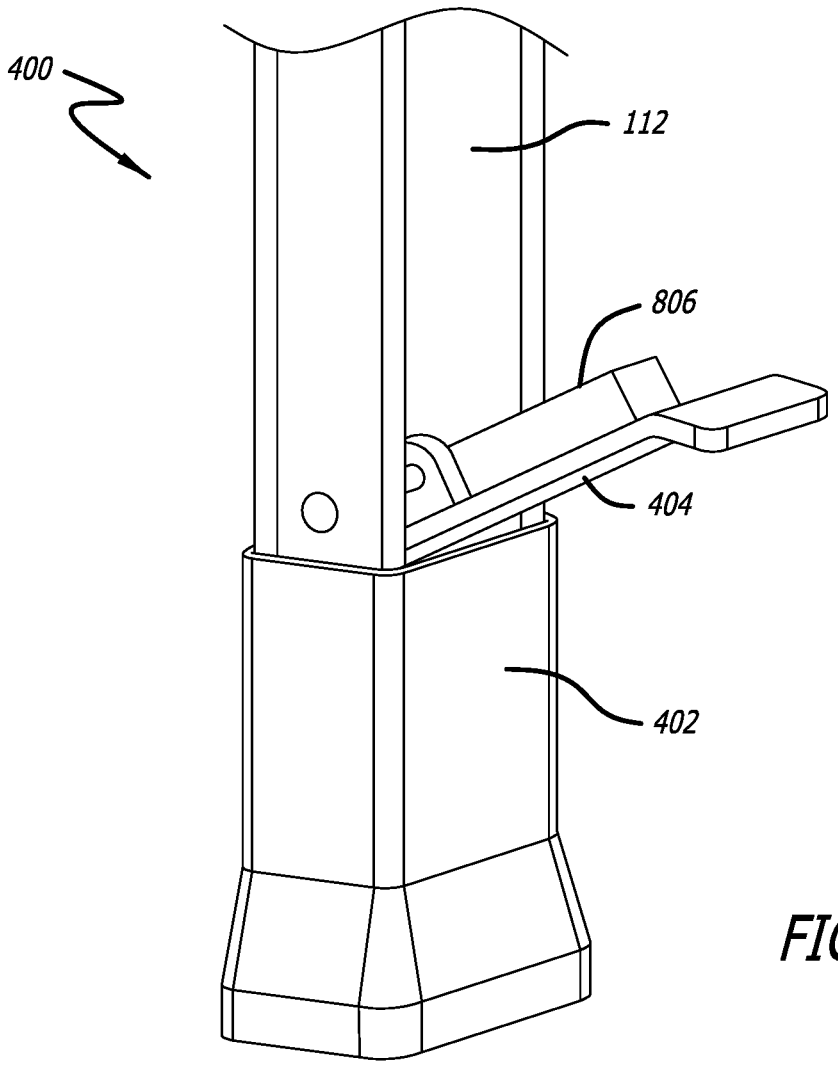
FIG. 9 is a perspective view of the extension foot assembly illustrated in FIG. 4, where the lever is positioned up along the length of the shower caddy and in an outward position.
Figure 10:
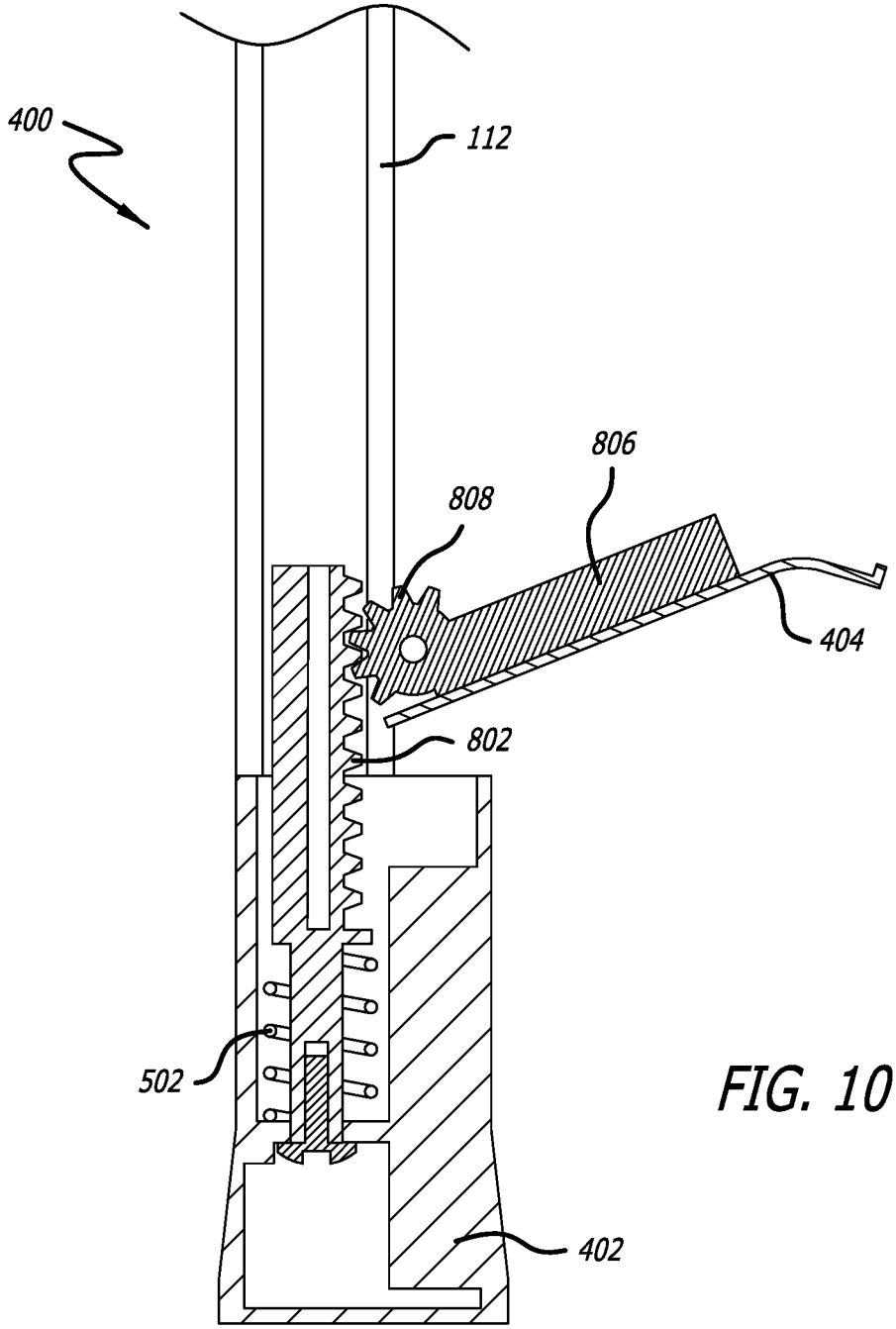
FIG. 10 is a cross-sectional view of the extension foot assembly illustrated in FIG. 4, where the lever is positioned up along the length of the shower caddy and in the outward position.
Figure 11:
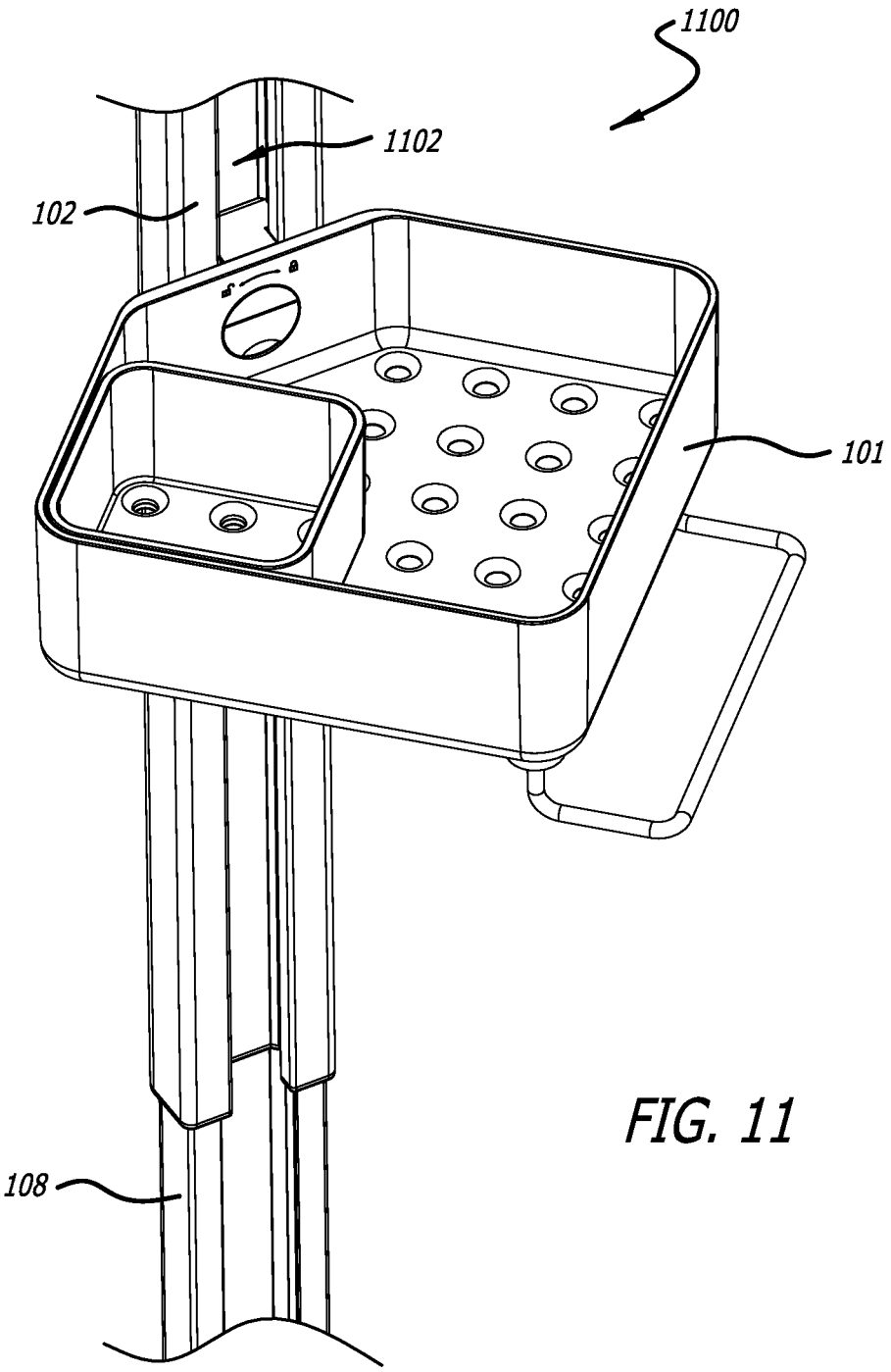
FIG. 11 is a perspective view of an example of a shelf support assembly of the shower caddy illustrated in FIG. 1 according to an implementation of the present disclosure.

FIGS. 9 and 10 show perspective and cross-sectional views, respectively, of the extension foot assembly 400 of the shower caddy 100 of FIG. 1 where the lever 404 is positioned up along the length of the shower caddy 100 and in the outward position. As discussed above, when the lever 404 is moved to an outward position, the foot member 402 retracts towards the second body 108, thus releasing the tension on the shower caddy 100.

FIGS. 11-14 illustrate one example of a shelf 101 that includes a shelf support assembly 1100 for mounting to either the first body 102 or the second body 108, and configured to adjust a vertical position of the shelf on the first body 102 or the second body 108. The shelf support assembly 1100 may include a first engagement member and a second engagement member as described further below. In the example shown in FIG. 11, the shelf support assembly 1100 is positioned at the rear end of the shelf 101 for mounting the shelf 101 to the first body 102 or the second body 108. The first body 102 may include an engaging portion (or second engagement member) 1102, such as a track or groove. The engaging portion 1102 may extend generally parallel with the longitudinal axis of the first body 102 or the second body 108 (or more generally the longitudinal axis of the shower caddy 100). In certain variants, the engaging portion 1102 is located within or inside the first body 102. The engaging portion 1102 may be configured to engage with the shelf support assembly 1100, as discussed in more detail below.

Figure 12:
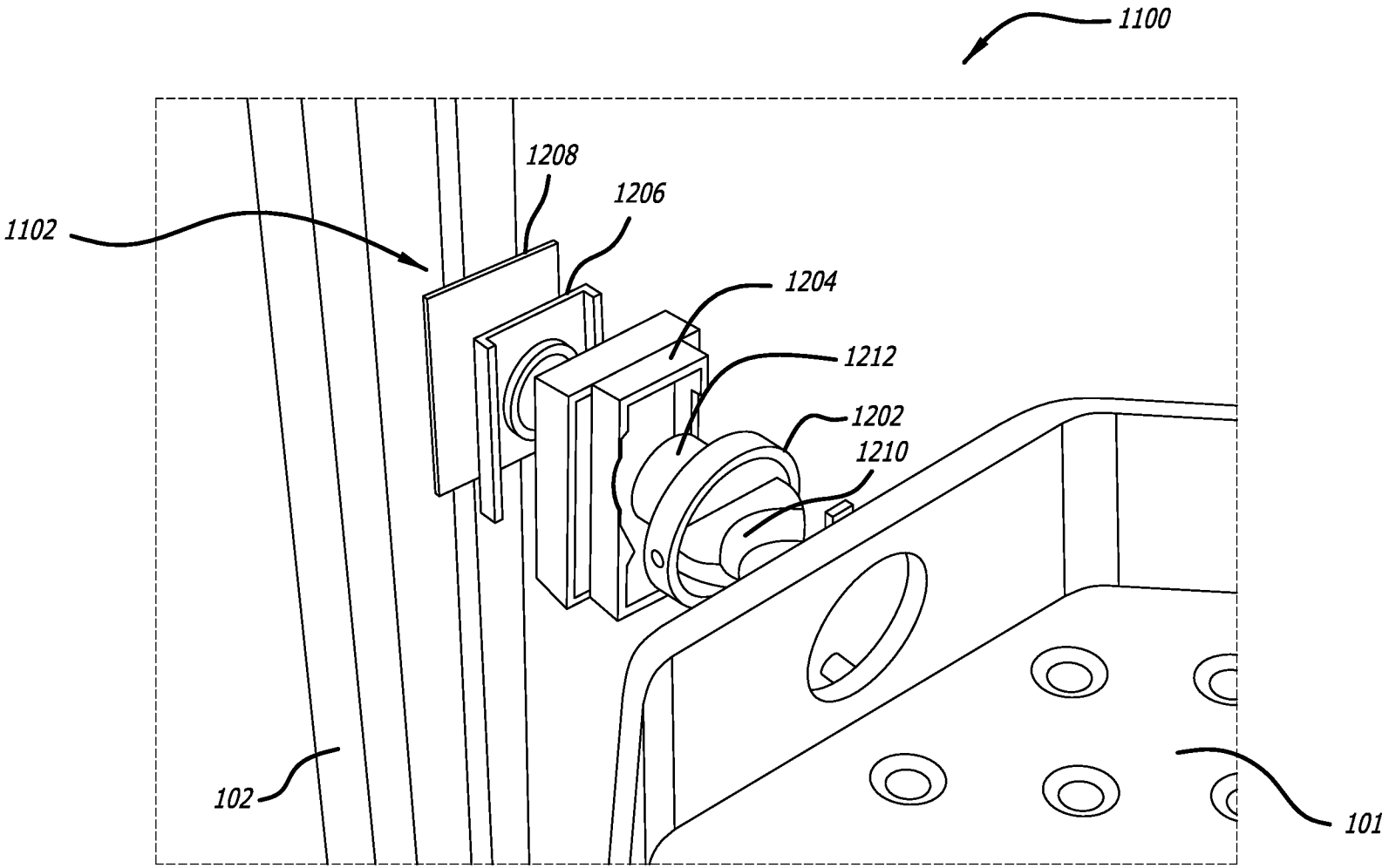
FIG. 12 is an exploded view of the shelf support assembly illustrated in FIG. 11.

FIG. 12 is an exploded view of the shelf support assembly 1100. The shelf support assembly 1100 allows a user to adjust the vertical position of the shelf 101 on the shower caddy 100 in addition to holding it in place on either the first or second body 102, 108. As shown, the shelf support assembly 1100 may include an adjustment portion 1202 (that may be or include a dial or knob, as illustrated), a front support member 1204, a clamping member 1206 and a rear support member 1208. The adjustment portion 1202 has a front end 1210 and rear end 1212. As shown, the front end 1210 may include a tab for the user to grip and turn and the rear end 1212 may include an angled (or helical) threaded portion, similar to a screw. In the present example, the above-noted first engagement member may correspond to the adjustment portion 1202, or additionally associated components. In the present example, the threaded portion of the rear end 1212 includes an outer thread that engages a surface of the second engagement member (e.g., engaging portion 1102) or a surface of the shelf support assembly 1100, in either case thereby allowing adjustment of a clamping force between the shelf support assembly 1100 and the first body 102 (or second body 108). By this configuration, the engagement between the shelf support assembly 1100 (and thus the shelf 101) and the first body 102 is a frictional engagement. The movement of the adjustment portion 1202 (e.g., the turning of the dial) translates the shelf support assembly 1100 (or at least portions of the shelf support assembly 1100 outside of the first body 102 toward or away from the first body 102 along an axis (e.g., horizontal axis) perpendicular to the longitudinal axis of the shower caddy 100, thereby adjusting the frictional force (i.e., the clamping force or, more generally, an engagement force) between the shelf support assembly 1100 and the first body 102.

In another implementation (not shown), the threaded portion of the rear end 1212 passes through a hole of the clamping member 1206 and into a hole or socket of the engaging portion 1102. In this example, the hole or socket of the engaging portion 1102 includes a threaded portion that includes a complementary internal thread (i.e., configured to mate with the external thread of the threaded portion of the rear end 1212 of the adjustment portion 1202). By such configuration, the engagement between the first engagement member (e.g., adjustment portion 1202) and the second engagement member (e.g., engaging portion 1102) is a threaded engagement, or additionally a clamping engagement. That is, the extent to which the external thread is threaded into the internal threaded portion may vary a clamping force clamping force between the shelf support assembly 1100 and the first body 102.

In operation, the turning of the adjustment portion 1202 (e.g., dial) in one direction allows for the shelf 101 to be securely fastened to the first body 102 by increasing the clamping force between the shelf support assembly 1100 and the first body 102. On the other hand, the turning of the adjustment portion 1202 (e.g., dial) in the opposite direction allows for the second engagement member (e.g., engaging portion 1102), and thus the shelf 101, to become loose relative to the first body 102 by decreasing the clamping force between the shelf support assembly 1100 and the first body 102, thereby allowing the shelf 101 (and the shelf support assembly 1100) to be slid up or down the first body 102 together with the second engagement member. By this configuration, the shelf 101 may be adjusted or moved to any vertical position on the first body 102 within the structural constraints of the first body 102.

Figure 13:
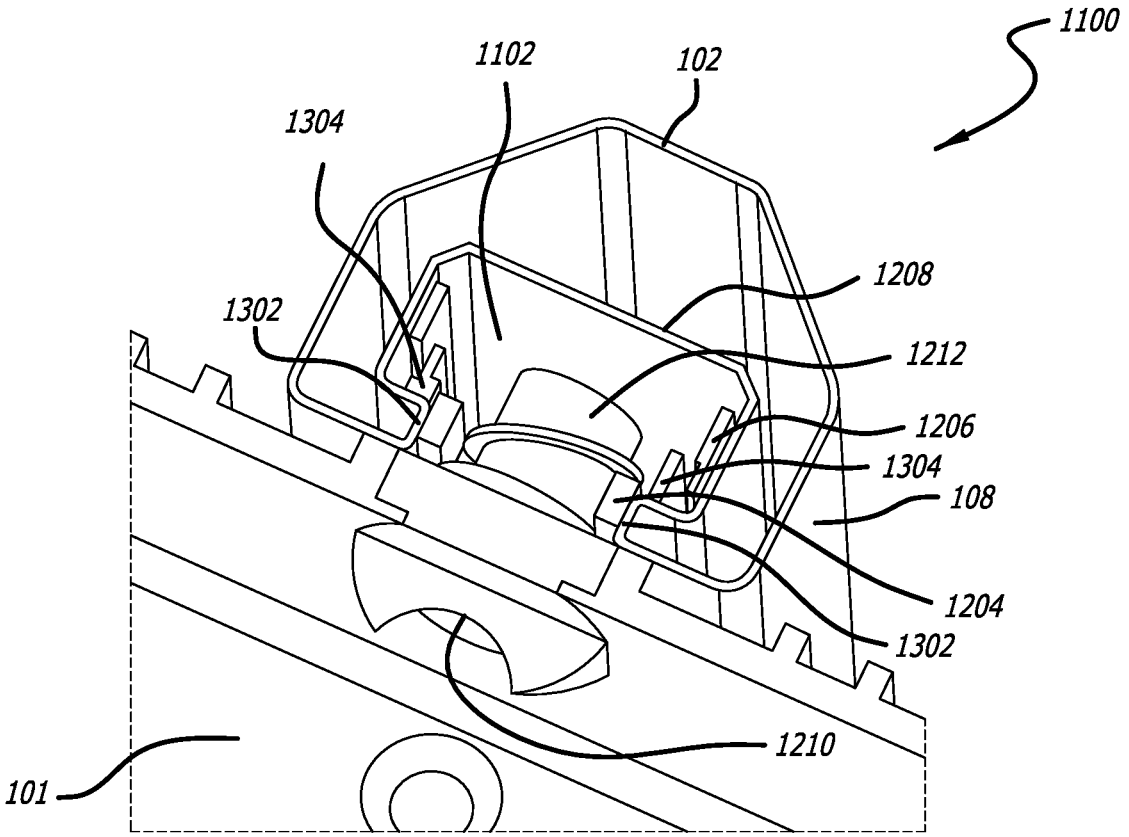
FIG. 13 is a cross-sectional view of the shelf support assembly illustrated in FIG. 11.

FIG. 13 is a cross-sectional view of the shelf support assembly 1100 engaging with the first body 102 of the shower caddy 100. As shown, the engaging portion 1102 may be generally parallel with the longitudinal axis of the shower caddy 100 (e.g., the longitudinal axis of the first body 102 or second body 108). The engaging portion 1102 is configured to engage with the shelf support assembly 1100 as described above. In the illustrated example, the engaging portion 1102 (and/or the first body 102 or second body 108) includes two flanges 1302 that extend inwardly towards one another, thereby allowing the shelf support assembly 1100 to frictionally engage with rear surfaces 1304 of the flanges 1302. In operation, the turning of the front end 1210 of the dial (adjustment portion 1202, FIG. 12) in one direction (e.g., clockwise direction) allows the angled threaded portion on the rear end 1212 of the dial to engage with the clamping member 1206 and clamp the clamping member 1206 against the rear surfaces 1304 of flanges 1302. As mentioned above, the clamping member 1206 may clamp to any vertical portion of the engaging portion 1102 such that the shelf 101 can be adjusted and frictionally clamped to any vertical position on the first body 102 (or second body 108). Similarly, when the front end 1210 of the dial is turned in the opposite direction (e.g., counter-clockwise direction), the angled threaded portion on the rear end 1212 of the dial disengages with the clamping member 1206 such that the shelf 101 may then be adjusted and frictionally clamped to another vertical position on the shower caddy 100.

Figure 14A:
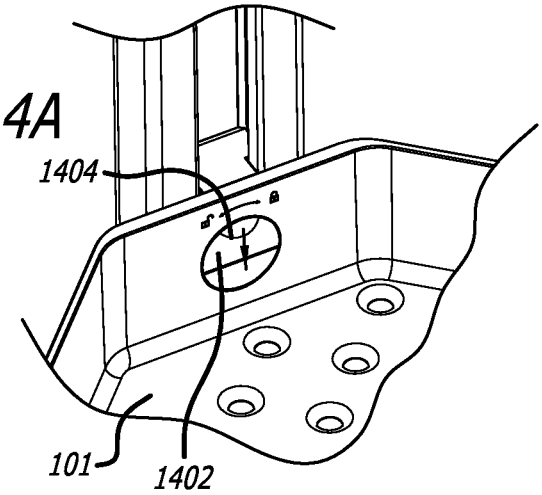
FIG. 14A is a perspective view of an example of an adjustment portion of the shelf support assembly of FIG. 11 according to an implementation of the present disclosure.
Figure 14B:
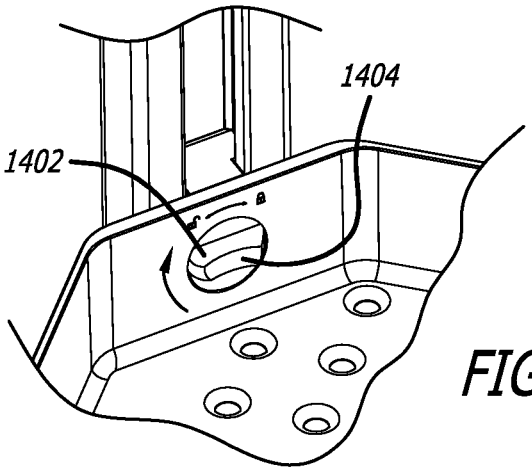
FIG. 14B is another perspective view of an example of the adjustment portion illustrated in FIG. 14A.
Figure 14C:
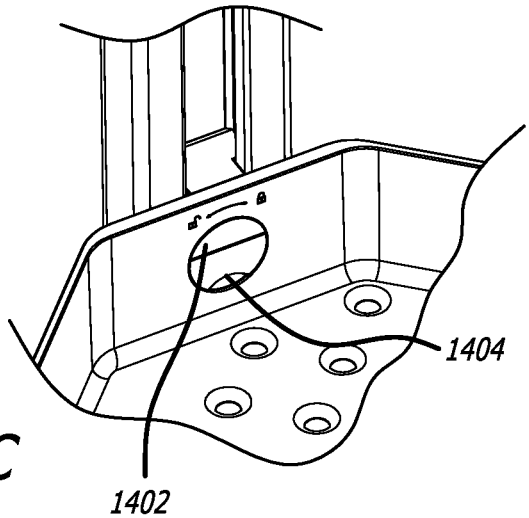
FIG. 14C is another perspective view of an example of the adjustment portion illustrated in FIG. 14A.

FIGS. 14A-14C show one example of an adjustment portion 1202 of the shelf support assembly 1100. As shown, the adjustment portion 1202 may include a tab 1402 that extends outwardly from the shelf 101 and may also retract such that it is flush with the rear front surface of the shelf 101. A notch 1404 may be provided on the tab 1402 to allow the user to more easily move the tab 1402 to an outward position and retracted position. FIG. 14 also shows how the rotation of the tab 1402 in a clockwise and counter-clockwise direction can lock and unlock (or clamp and unclamp (release)) the shelf 101 to the first body 102 (or second body 108).

Figure 15:
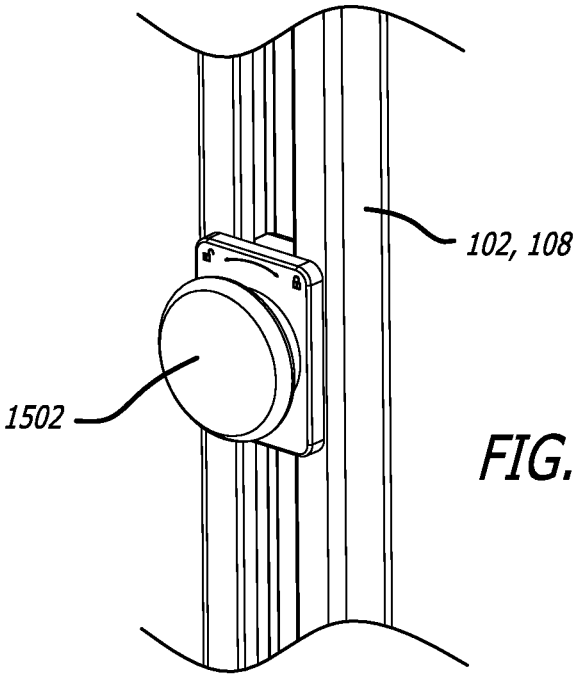
FIG. 15 is a perspective view of another example of an adjustment portion of a shelf support assembly of the shower caddy illustrated in FIG. 1 according to an implementation of the present disclosure.

FIG. 15 shows another example of an adjustment portion 1202 of the shower caddy 100. As shown, instead of a dial as shown in FIG. 14, the adjustment portion 1202 may include a magnet 1502 that may be rotated in a clockwise and counter-clockwise direction for locking and unlocking the magnet 1502 to the first body 102 (or second body 108). This magnet 1502 may act as a magnetic mount for other accessories to be magnetically mounted to the shower caddy 100. These other accessories may include, but are not limited to, a shelf, a shower mirror or a shower speaker (e.g., a Bluetooth speaker). The adjustment portion 1202 may be utilized in accordance with the same clamping mechanism provided in connection with shelf support assembly 1100.

Figure 16:
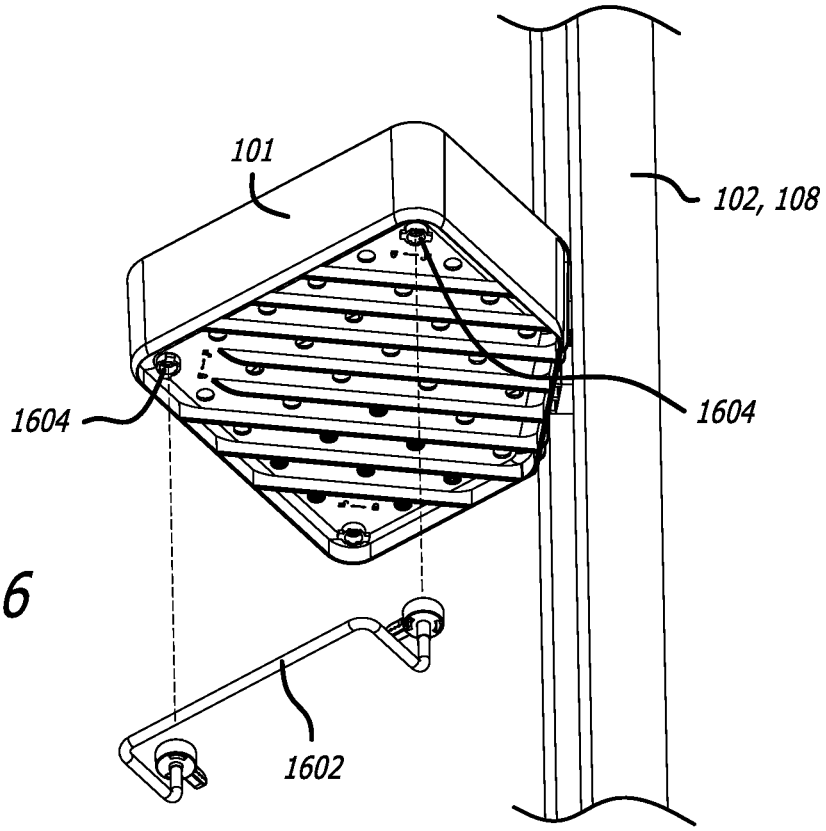
FIG. 16 is a bottom perspective view of an example of a shelf of the shower caddy illustrated in FIG. 1 according to an implementation of the present disclosure.

FIG. 16 is a bottom perspective view of one example of the bottom of a shelf 101 of the shower caddy 100. As shown, the bottom of the shelf 101 may include a bar 1602 that is mounted to holes 1604 located on the base of the shelf. The bar 1602 can vary in shape or length and can be used as an accessory for storing or hanging items.

Figure 17:
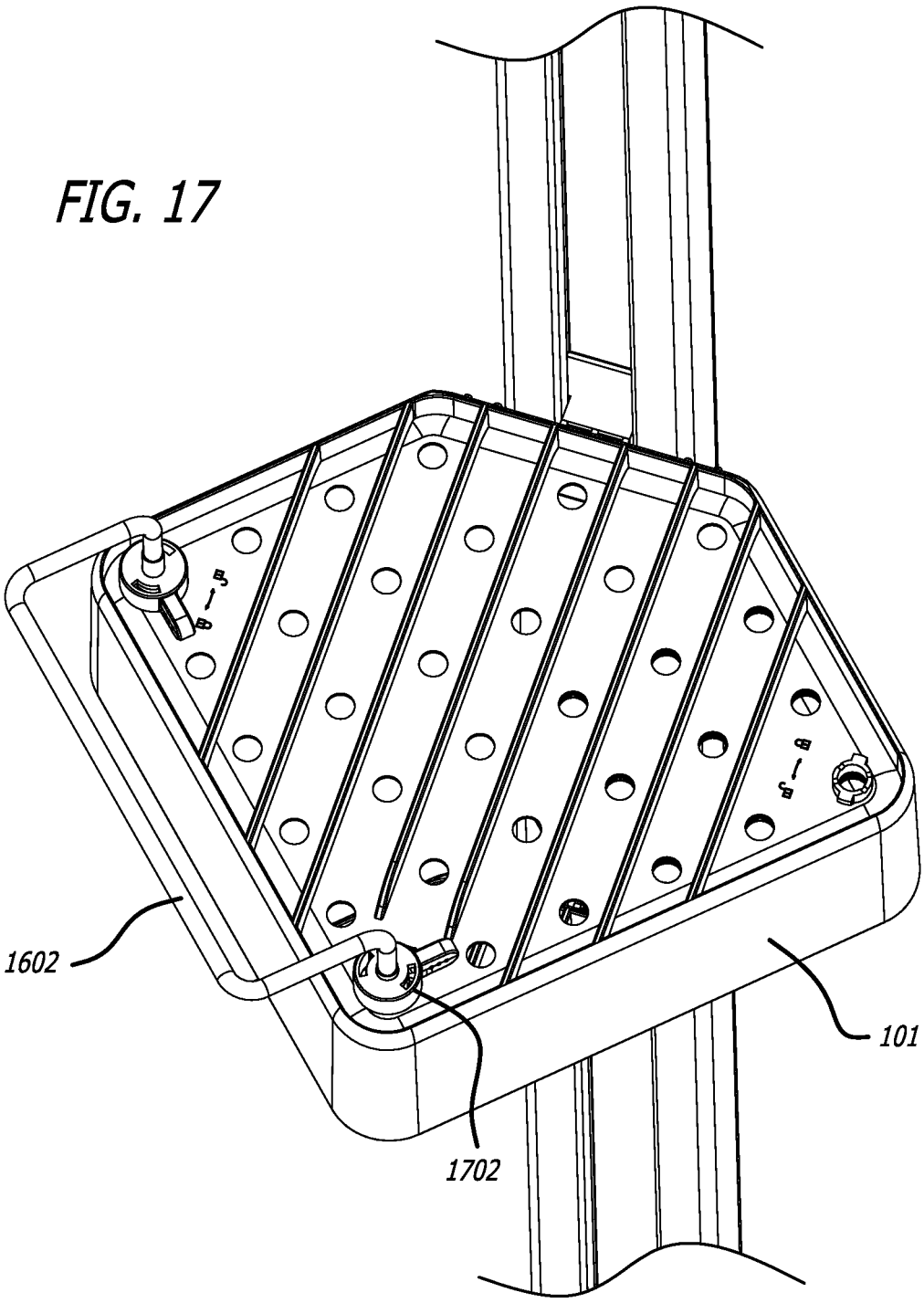
FIG. 17 is another bottom perspective view of the shelf illustrated in of FIG. 16.

FIG. 17 is another bottom perspective view of the bottom of the shelf shown in FIG. 16. FIG. 17 shows that the bar 1602 may be mounted to the bottom of the shelf 101 by attachments 1702 that may turn in a clockwise and counter clockwise direction to frictionally mount the bar 1602 to the bottom of the shelf 101.

Figure 18:
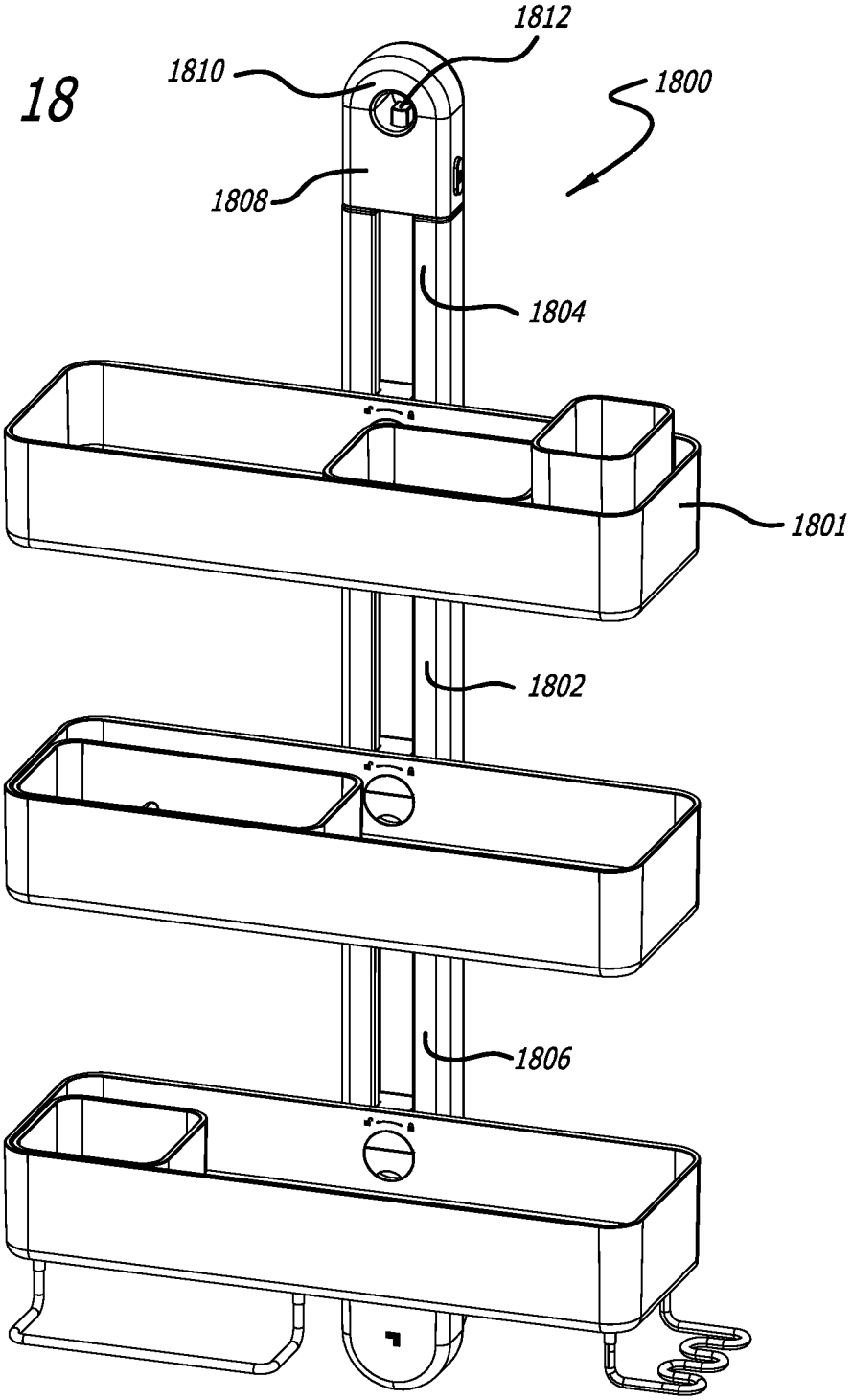
FIG. 18 is a front perspective view of another example of a shower caddy according to an implementation of the present disclosure.
Figure 20A:
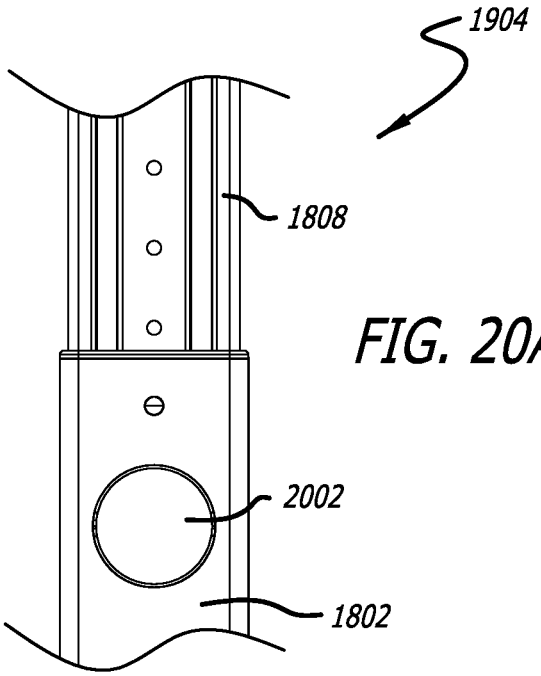
FIG. 20A is a front elevation view of an example of an extension mechanism that may be mounted to the shower caddy illustrated in FIG. 18.
Figure 20B:
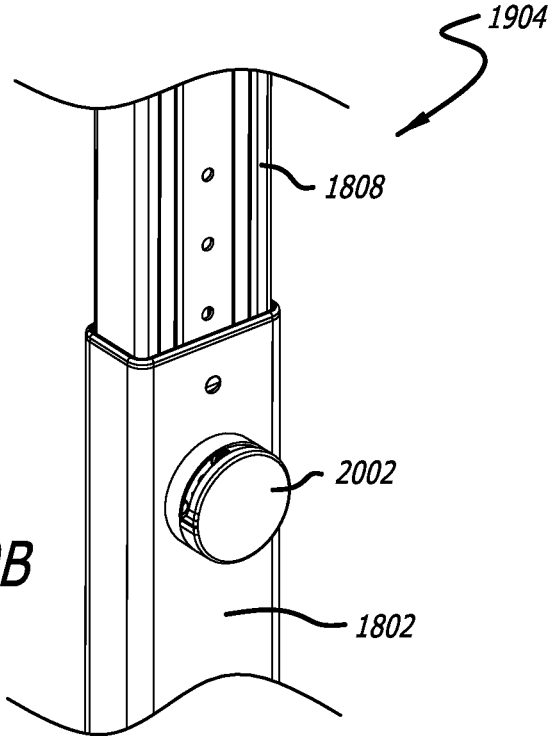
FIG. 20B is a perspective elevation view of the extension mechanism illustrated in FIG. 20A.

FIG. 18 is a front perspective view of another example of a shower caddy 1800. In particular, the shower caddy 1800 may be a hanging shower caddy such that it hangs on a shower head for example. Shower caddy 1800 can have one, two, three, four, or more shelves 1801 where the shelves 1801 may vary in different shapes and/or sizes. In general, the shower caddy 1800 includes a first telescoping tubular body 1802 having a telescoping first end 1804 and a first free end 1806, and a second telescoping tubular body 1808 having a telescoping first end (not shown) and a second free end 1810. As best shown in FIGS. 20A and 20B, the first and second bodies 1802, 1808 are telescoped to allow variation of the length/height of the shower caddy 1800. For this function, the second body 1808 may be smaller in diameter compared to the first body 1802 such that the second body 1808 slides relative to (and inside) the first body 1802. Alternatively, the first body 1802 may be smaller in diameter compared to the second body 1808 such that the first body 1802 slides relative to (and inside) the second body 1808.

FIG. 18 also shows that the shower caddy 1800 includes a loop mechanism 1812 located at the free end 1810 of the second body 1808. The loop mechanism 1812 can be configured to support the weight of the shower caddy 1800 from a shower head (not shown) or a pipe leading to a shower head.

Figure 19:
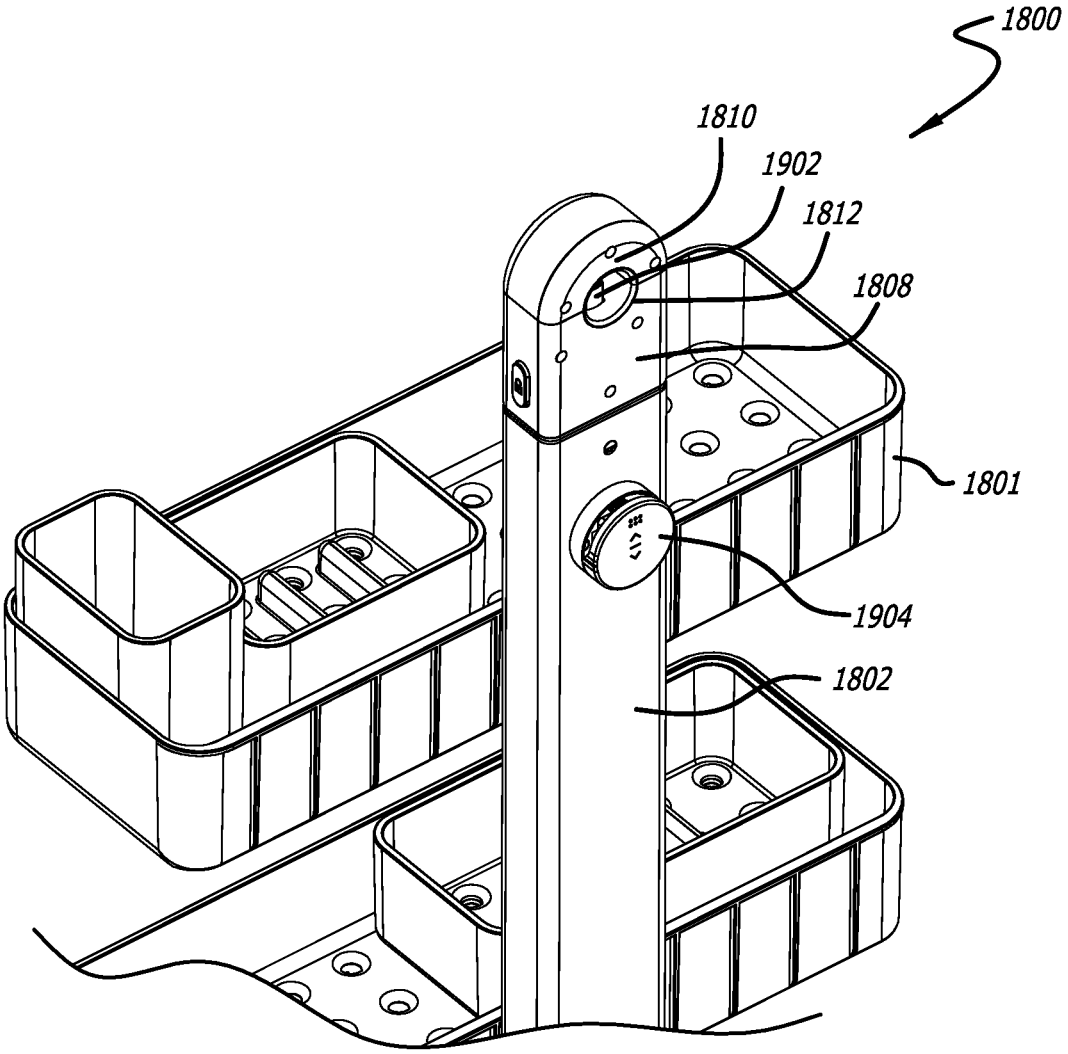
FIG. 19 is a back perspective view of an upper portion of the shower caddy illustrated in FIG. 18.

FIG. 19 is a top back perspective view of the shower caddy 1800. As shown, the loop mechanism 1812 may include a spring load member 1902 within the hole of the loop mechanism 1812. The spring load member 1902 allows for the loop mechanism 1812 to accommodate to the different diameter sizes of the shower head or pipe leading to a shower head. Also shown in FIG. 19 is an extension mechanism 1904 that may be mounted to shower caddy 1800. This extension mechanism 1904 will be discussed in greater detail below.

FIGS. 20A and 20B are perspective views of the extension mechanism 1904 that may be mounted to shower caddy 1800. As shown, the extension mechanism 1904 may include an actuator 2002 that is mounted to the first body 1802 for adjusting the span of the shower caddy 1800.

Figure 21:
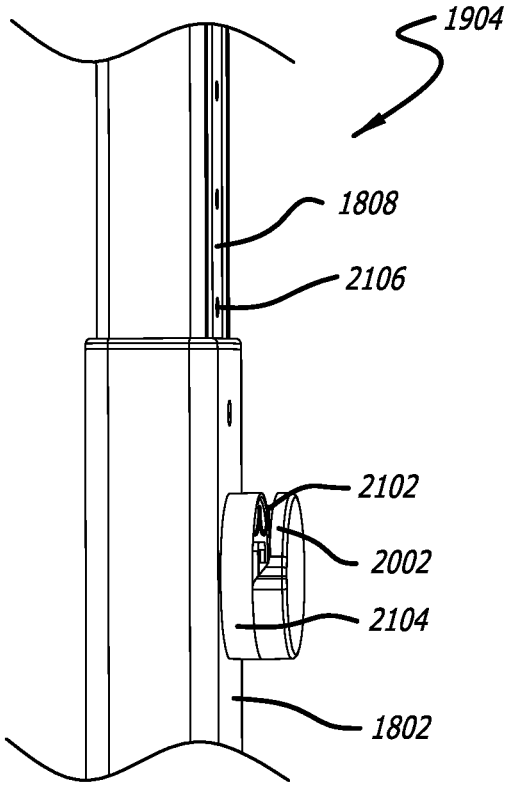
FIG. 21 is a perspective elevation view of an internal mechanism of the extension mechanism illustrated in FIG. 20A.

FIG. 21 is an illustration of the internal mechanism of the extension mechanism 1904 that may be mounted to shower caddy 1800. As shown, the extension mechanism 1904 may include an actuator 2002 that acts as a spring-loaded lever (see spring member 2102) with a pin 2104 that is movable into holes 2106 located on the second body 1808. The actuator 2002 is configured such that in operation, pressing the actuator 2002 releases the pin 2104 from the holes 2106, thereby allowing the user to adjust the length of the shower caddy 1800. Additionally, releasing the actuator 2002 will allow the pin 2104 to lock into one of the holes 2106. It should be noted that both extension mechanisms 200 and 1904 described above may be interchanged with one another on the shower caddies 100 and 1800. In other words, in another implementation, the shower caddy 100 may include the extension mechanism 1904 and the shower caddy 1800 may include the extension mechanism 200. Furthermore, it should be understood that the shelf support assembly 1100 and/or the adjustment portion 1202 described above may also be incorporated into the shower caddy 1800.

Figure 22:
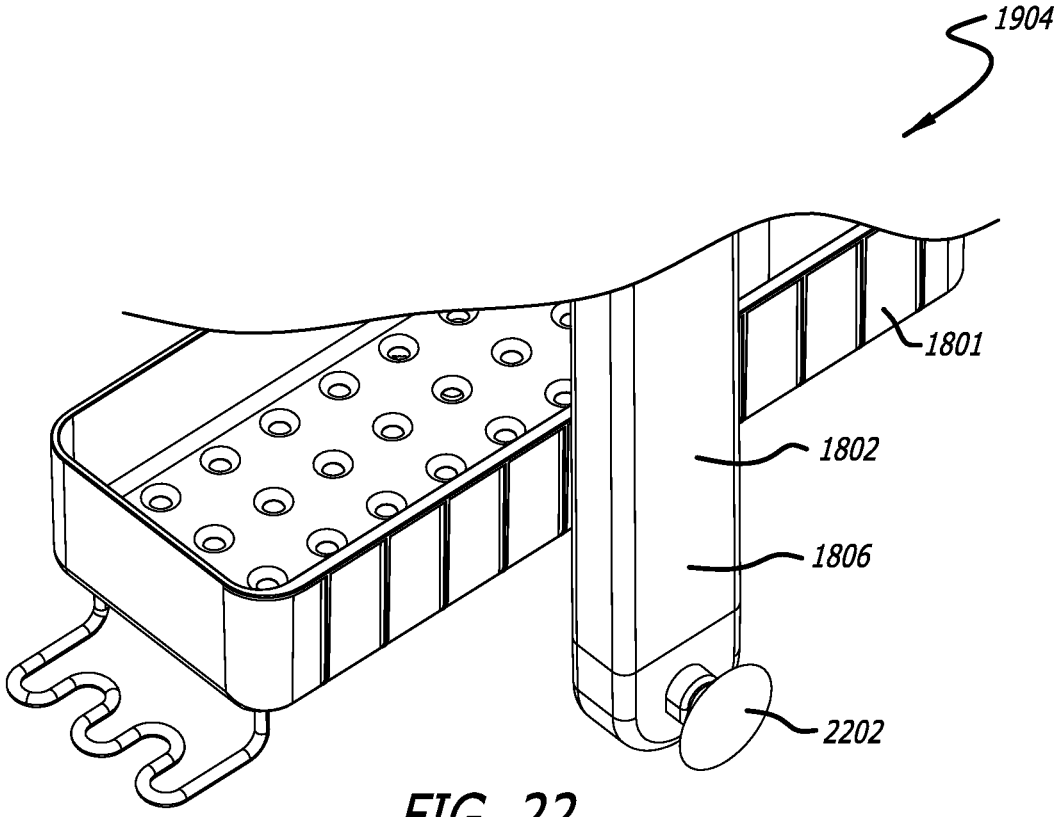
FIG. 22 is a perspective view a lower portion of the shower caddy illustrated in FIG. 18.

FIG. 22 is a bottom back perspective view of the shower caddy 1800. One or more suction cups 2202 may be located at various positions along the length of the first body 1802 to securely attach the shower caddy 1800 to a structure external to and separate from the shower caddy 100, such as a shower or bath wall (not shown). In the illustrated example, a suction cup 2202 is mounted to the free end 1806 of the first body 1802.

Figure 23:
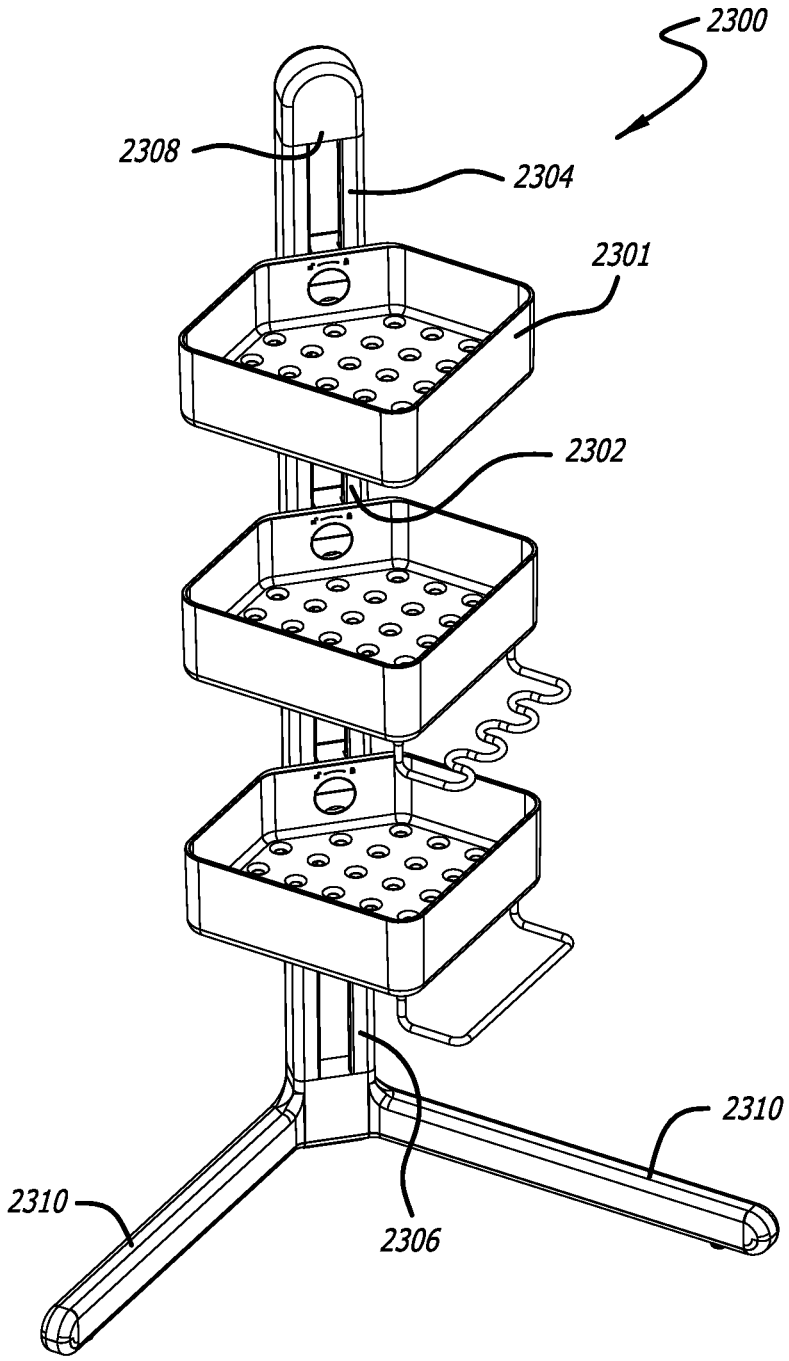
FIG. 23 is a front perspective view of another example of a shower caddy according to an implementation of the present disclosure.

FIG. 23 is a front perspective view of another example of a shower caddy 2300. The shower caddy 2300 may be configured as a standing shower caddy having at least one leg 2310 for allowing the shower caddy 2300 to stand on an underlying support surface (e.g., a floor). The shower caddy 2300 can have one, two, three, four, or more shelves 2301 where the shelves 2301 may vary in different shapes and/or sizes. In one implementation, the shower caddy 2300 may have one tubular body that is not telescopic, or one tubular body that is not telescopic and another that is telescopic and is movable relative to the non-telescopic tubular body. In another implementation, the shower caddy 2300 may have a first telescoping tubular body 2302 having a telescoping first end 2304 and a (first) free end 2306 and a second telescoping tubular body 2308 that slides inside the first telescoping tubular body 2302. It should also be understood that the shower caddy 2300 may include the extension mechanism 200 or extension mechanism 1904 described above and illustrated in FIGS. 2-3C and FIG. 19, respectively. Additionally, it should be understood that the shelf support assembly 1100 and/or adjustment portion 1202 described above and illustrated in FIGS. 11-15 may also be incorporated into the shower caddy 2300.

More generally, the present disclosure encompasses one or more other implementations in which shower caddies include a combination of two or more features described above or additionally illustrated in two or more of FIGS. 1-23.

The foregoing description of implementations has been presented for purposes of illustration and description. It is not exhaustive and does not limit the claimed inventions to the precise form disclosed. Modifications and variations are possible in light of the above description or may be acquired from practicing the invention. The foregoing description is for the purpose of illustration only, and not for the purpose of limitation. The claims and their equivalents define the scope of the invention.

What is claimed is:

1. A shower caddy, comprising:

a first body comprising a telescoping first end and a first free end;

a second body comprising a telescoping first end and a second free end, wherein the telescoping first end of the first body is coupled to the telescoping first end of the second body such that the second body is slidable relative to the first body along a longitudinal axis of the shower caddy, and the first body and the second body are configured for telescopic movement to allow variation of a length of the shower caddy along the longitudinal axis;

a shelf supported by the first body or the second body; and an extension foot assembly configured to adjust tensioning of the shower caddy, the extension foot assembly comprising:

a foot member movably mounted to the second free end; and a lever in operative communication with the foot member, where the lever is configured to move between a retracted position and an outward position where as the lever is moved toward the retracted position the foot member is configured to extend outwardly from the second free end along the longitudinal axis of the shower caddy, and where the lever is further configured to move between a first position and a second position along the longitudinal axis of the shower caddy when in the retracted position.

2. The shower caddy of claim 1, where the lever is capable of moving to the outward position when the lever is in its first position and is not capable of moving to the outward position when the lever is in its second position.

3. The shower caddy of claim 1, where an extension mechanism is configured to adjust the length of the shower caddy, where the extension mechanism comprises an actuator configured to alternately engage the first body and the second body to each other and disengage the first body and the second body from each other.

4. The shower caddy of claim 1, where the foot member includes a linear gear.

5. The shower caddy of claim 1, where when in the second position, the lever is partially positioned behind the foot member.

6. The shower caddy of claim 4, where the lever includes a circular gear that engages with the linear gear for moving the linear gear of the foot member linearly along the longitudinal axis of the shower caddy when the lever is moved between the retracted position and the outward position.

7. A shower caddy comprising:

a first body comprising a telescoping first end and a first free end;

a second body comprising a telescoping first end and a second free end, wherein the telescoping first end of the first body is coupled to the telescoping first end of the second body such that the second body is slidable relative to the first body along a longitudinal axis of the shower caddy, and the first body and the second body are configured for telescopic movement to allow variation of a length of the shower caddy along the longitudinal axis;

a shelf supported by the first body or the second body;

a first body comprising a telescoping first end and a first free end;

an extension foot assembly configured to adjust tensioning of the shower caddy, the extension foot assembly comprising:

a foot member movably mounted to the second free end, where the foot member includes a linear gear;

a lever having a circular gear that engages with the linear gear, where the lever is configured to move between a retracted position and an outward position, where as the lever is moved toward the retracted position the circular gear moves the linear gear of the foot member linearly along the longitudinal axis of the shower caddy.

8. The shower caddy of claim 7, where the lever is further configured to move along the longitudinal axis of the shower caddy when in the retracted position.

9. The shower caddy of claim 8, where the lever, when in its retracted position, is configured to move linearly along the longitudinal axis of the shower caddy between a first position and a second position.

10. The shower caddy of claim 8, where the lever is capable of moving to the outward position when the lever is in its first position and is not capable of moving to the outward position when the lever is in its second position.

11. The shower caddy of claim 7, where the lever includes an outwardly protruding handle.

12. The shower caddy of claim 7, where the extension foot assembly comprises a spring member contacting the foot member and the lever, wherein at the retracted position the spring member is compressed, and at the outward position the spring member is relaxed.

13. The shower caddy of claim 7, where the lever, when in the retracted position, moves along the longitudinal axis of the shower caddy behind the foot member.

14. The shower caddy of claim 7, where an extension mechanism is configured to adjust the length of the shower caddy, where the extension mechanism comprises an actuator configured to alternately engage the first body and the second body to each other and disengage the first body and the second body from each other.

15. The shower caddy of claim 7, where the extension foot assembly comprises a spring member configured to bias the shower caddy toward an underlying surface that supports the shower caddy.

16. A shower caddy comprising:

an elongated body having a front wall, rear wall, and side walls, where the front wall includes a track the extends parallel to the longitudinal axis of the elongated body;

a shelf support assembly configured to mount a shelf to the elongated body, where the shelf includes a shelving area configured to support one or more bath articles, where the shelf is mounted to the elongated body via a mounting mechanism received within the track, where the mounting mechanism comprises a dial and a clamping member, where the dial is configured to rotate between a first direction and a second direction, where the rotation in the first direction increases the amount of pressure between the clamping member to the track, where the rotation in the second direction decreases the amount of pressure between the clamping member to the track, where the dial is positioned within the shelving area.

17. The shower caddy of claim 16, where the dial includes a tab the moves between an outward position and retracted position.

18. The shower caddy of claim 16, where the dial includes a threaded portion for engaging with the clamping member.

19. The shower caddy of claim 16, where the shelf includes at least one bar removably mounted to the shelf for storing or hanging one or more bath articles.

* * * * *